US005178414A

United States Patent [19]

Small et al.

[11] Patent Number: 5,178,414

[45] Date of Patent: Jan. 12, 1993

[54] PROTECTIVE MAGAZINE COVER

[75] Inventors: Edward L. Small, Massillon; Philip M. Zavracky, Stow, both of Ohio

[73] Assignee: Kent Adhesive Products Co., Kent, Ohio

[21] Appl. No.: 749,860

[22] Filed: Aug. 26, 1991

[51] Int. Cl.[5] ..... B42D 3/02; B42D 3/18

[52] U.S. Cl. ..... 281/35; 281/15.1; 281/29; 281/34

[58] Field of Search ..... 281/15.1, 29, 34, 35

[56] References Cited

U.S. PATENT DOCUMENTS

| | | | |
|---|---|---|---|
| 3,572,767 | 3/1971 | Learned | 281/29 X |
| 4,497,508 | 2/1985 | McHugh | 281/35 X |
| 4,893,979 | 1/1990 | Alpers | 281/35 X |
| 5,052,872 | 10/1991 | Hunder et al. | 281/35 X |
| 5,087,078 | 2/1992 | Phillips | 281/34 X |

FOREIGN PATENT DOCUMENTS

| | | | |
|---|---|---|---|
| 1556767 | 11/1979 | United Kingdom | 281/35 |

*Primary Examiner*—Paul A. Bell

*Attorney, Agent, or Firm*—Renner, Kenner, Greive, Bobak, Taylor & Weber

[57] ABSTRACT

A protective magazine cover consists of a pair of transparent polyester sheets secured at opposed lateral edges thereof by means of an appropriate pressure sensitive adhesive tape. A portion of the adhesive of the tape along the lateral edges thereof secures the sheets, while a portion of the pressure sensitive adhesive therebetween is adapted for making secured engagement of a magazine cover along either side of the spine thereof. In one embodiment of the invention, a tail of tape extends longitudinally from the ends thereof and is provided with a flap for making securing engagement with the inner page of the magazine.

12 Claims, 2 Drawing Sheets

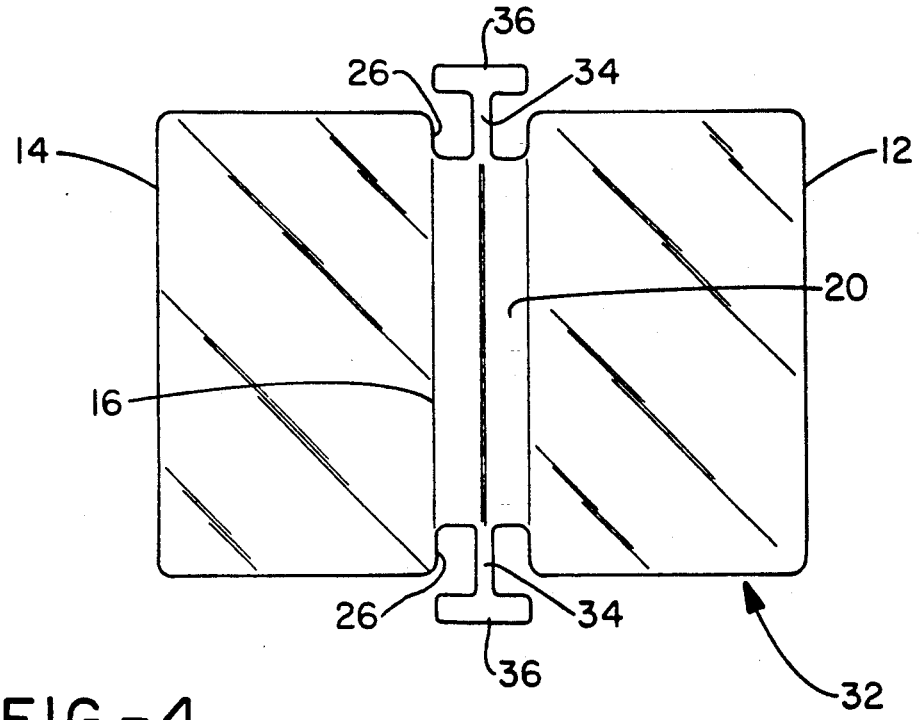
FIG.-4
FIG.-5
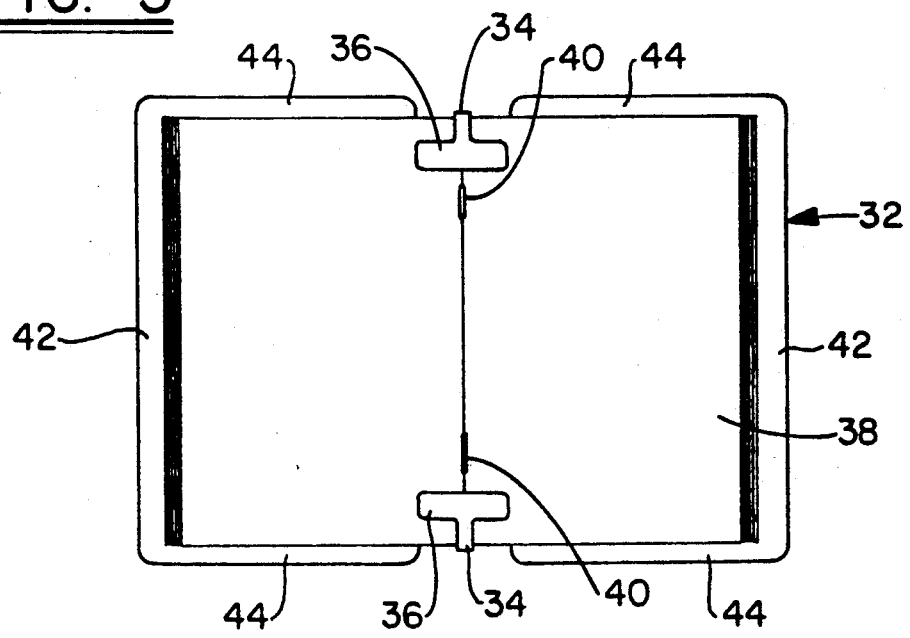

PROTECTIVE MAGAZINE COVER

TECHNICAL FIELD

The invention herein resides in the art of protective devices and, more particularly, to protective magazine covers. Specifically, the invention relates to a protective magazine cover which adheres to the lateral edges of the original magazine cover along the spine, and which may also serve to reinforce the magazine as a whole.

BACKGROUND ART

Magazines and periodicals are widely known and used for the periodic distribution of information. In order to make these publications attractive for use, they must be manufactured inexpensively. As a result, such magazines and periodicals typically are not of a durable nature, but need not be since they are typically intended for use by one or two individuals over a short period of time. However, some magazines and periodicals are subjected to heavy use, particularly in libraries, reception areas of public facilities, and the like. Since magazines and periodicals often comprise a plurality of sheets stapled together in the center or otherwise weakly bound, and in which the cover is of paper similar to the pages themselves, they do not stand up well to such heavy use. Accordingly, there is a need in the art for protective magazine covers which may be added to such publications which will ultimately be subjected to high levels of use.

In the prior art, it was known to provide an opaque cover over the original cover of a magazine or periodical to protect the same. These prior protective covers for magazines were typically applied with a heat actuated glue and were attached to the cover along narrow bands extending on either side of the spine of the magazine. Since the glue was of the heat actuated type, and not transparent, the covers themselves were necessarily opaque to conceal the glue bands. With such opaque covers, the magazines could not be readily identified, and the attractive covers that are evident on many magazines and similar publications would be concealed. Additionally, and of equal importance, such prior art covers would necessarily conceal or obscure information contained on the spine of the magazine.

In the prior art, the necessity of heat activating glue or other bonding material would, of course, require an appropriate source of heat. This would give rise to certain degrees of danger to the user and surroundings. Additionally, heat activated adhesives are time consuming in use and require at least a minimal degree of skill and dexterity. Additionally, the prior art opaque heat activated glue type of covers were quite expensive and often cost prohibitive to facilities such as libraries and the like. Accordingly, there is a need in the art for a transparent magazine cover which may be used without the application of heat, and which is cost efficient.

DISCLOSURE OF INVENTION

In light of the foregoing, it is a first aspect of the invention to provide a protective magazine cover which is transparent.

Another aspect of the invention is to provide a protective magazine cover which uses a pressure sensitive adhesive bonding material.

Still a further aspect of the invention is the provision of a protective magazine cover which is cost effective.

Yet an additional aspect of the invention is the provision of a protective magazine cover which can be easily tailored to magazines of various sizes.

The foregoing and other aspects of the invention which will become apparent as the detailed description proceeds are achieved by a magazine cover, comprising: front and back cover sheets for respectively covering the front and back of a magazine; and a strip of pressure sensitive adhesive interconnecting adjacent lateral edges of the front and back cover sheets and extending therebetween.

Still further aspects of the invention are attained by a magazine cover, comprising: a transparent front cover sheet; a transparent back cover sheet; and a transparent pressure sensitive adhesive strip bridging adjacent lateral edges of said front and back cover sheets.

DESCRIPTION OF DRAWINGS

For a complete understanding of the objects, techniques, and structure of the invention, reference should be made to the following detailed description and accompanying drawings wherein:

FIG. 4 is a top plan view of a protective magazine cover according to another embodiment of the invention, providing a means for reinforcing the totality of the magazine by securing the inner pages thereof; and FIG. 5 is a top plan view of the center section of a magazine covered and reinforced by the embodiment of the invention shown in FIG. 4.

BEST MODE FOR CARRYING OUT THE INVENTION

Figure 1:
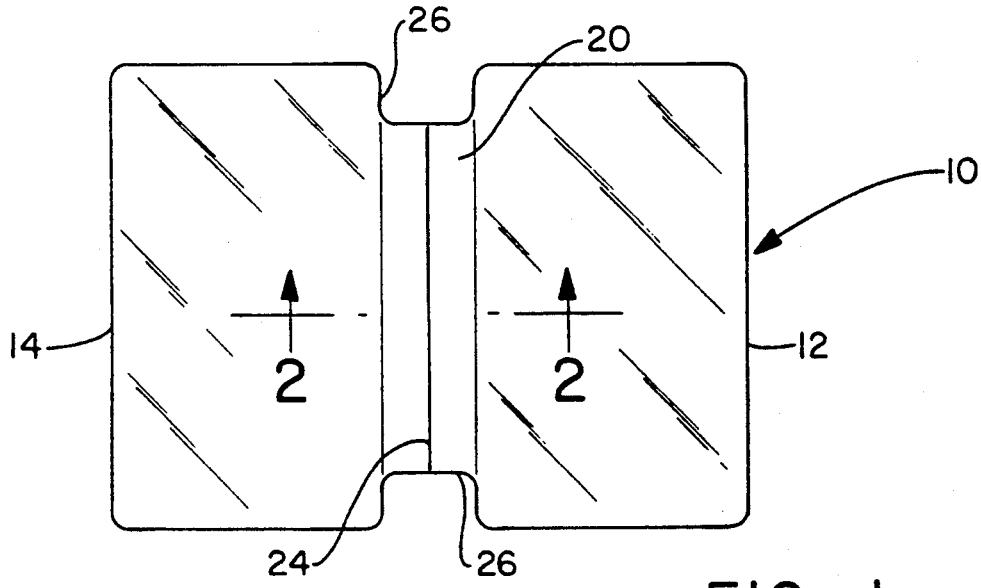
FIG. 1 is a top plan view of a protective magazine cover according to the invention.
Figure 2:
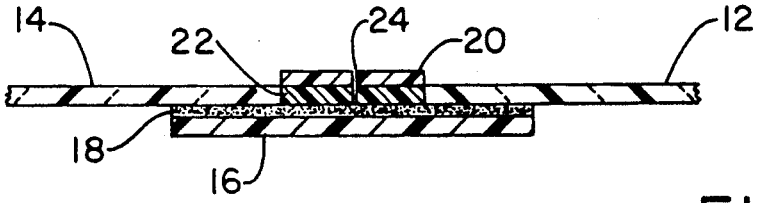
FIG. 2 is a cross sectional view of the spine portion of the protective magazine cover of FIG. 1 taken along the line 2—2, shown for illustrative purposes, and not necessarily to scale.

Referring now to the drawings and more particularly FIG. 1, it can be seen that a protective magazine cover according to the invention is designated generally by the numeral 10. As shown, the cover 10 includes a pair of side sheets 12, 14 which, in the preferred embodiment of the invention, are of a polyester material having a thickness on the order of 2–10 mils, and having a high degree of transparency. It will be appreciated as the description proceeds that the sheet 12 will serve as a protective cover for the back cover of the magazine, while the sheet 14 will serve to protect the front cover. As best shown in FIG. 2, a tape 16 comprising a polyester strip or film is interposed along adjacent lateral edges of the sheets 12, 14 and is adhered thereto by means of appropriate pressure sensitive adhesive 18. A portion of the adhesive layer 18, not adhered to either of the sheets 12, 14, remains covered by means of an appropriate backing sheet 20 carrying a release layer or coating 22. Those skilled in the art will readily perceive such to be a silicone release layer or the like. A score either partway through the backing sheet 20, or slit 24 all the way through the backing sheet 20 longitudinally traverses the sheet along the center thereof.

Those skilled in the art will readily appreciate that the tape 16 bearing the pressure sensitive adhesive 18 is originally congruently covered with the backing sheet 20 and release layer 22. An appropriate die cut or the like removes the lateral side portions of the backing sheet 20 and release layer 22 to expose the pressure sensitive adhesive 18 to be adhered to the adjacent edge portions of the sheets 12, 14. A suitable laminating machine or the like can provide this necessary function.

A cut-out portion 26 or an area of reduced length is provided in the center of the protective magazine cover 10 as best shown in FIG. 1. In the preferred embodiment of the invention, the cut-out area 26 has a width substantially equal to the width of backing sheet 20. The depth of the cut-out areas is preferably on the order of 1–3 cm. The purpose of the cut-out 26, which will become more apparent later herein, is to prevent the exposure of pressure sensitive adhesive 18 absent contact with the magazine cover once the protective cover 10 is employed.

Figure 3:
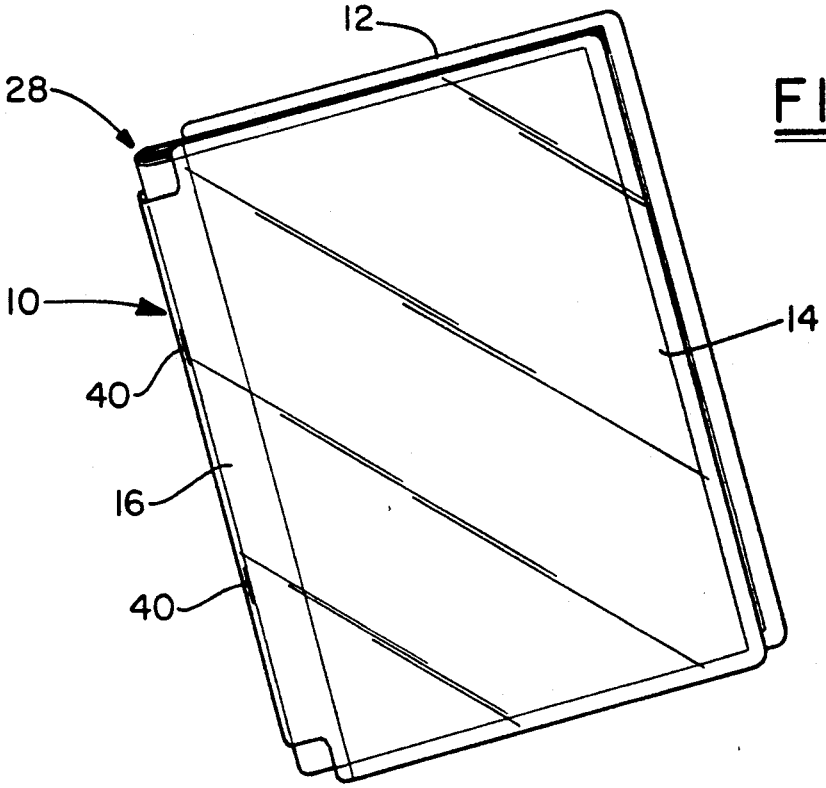
FIG. 3 is a perspective illustration of a magazine covered employing the apparatus and technique of the embodiment of the invention shown in FIGS. 1 and 2.

Referring now to FIG. 3, it can be seen that a magazine 28 is shown covered by the protective magazine cover 10 of FIG. 1. To practice the use of the invention, a cover 10 of sufficient size to extend beyond the cover of the magazine 28, both laterally and longitudinally, is selected. If the extention of the side sheets 12, 14 beyond the actual cover of the magazine is too great, the side sheets 12, 14 may be trimmed with an appropriate cutting device. In any event, it is preferred that the polyester sheets 12, 14 extend at least by some small portion beyond the paper cover of the magazine to provide total protection.

With the cover 10 appropriately selected and sized, one of the sheets of the backing sheet 20 is removed, exposing the pressure sensitive adhesive 18 therebeneath. The magazine 28 is centered longitudinally so that the sheets 12, 14 extend equal distances beyond the top and bottom edges of the magazine cover. The spine of the magazine 28 is, at the same time, aligned at the junction point of the exposed pressure sensitive adhesive 18 and the edge of the remaining portion of the backing sheet 20. The sheet 14 and tape 16 bearing the pressure sensitive adhesive layer 18 is then folded over the cover of the magazine 28, with the pressure sensitive adhesive 18 making contact with a portion of the front cover of the magazine along a band adjacent the cover 14. With the sheet 14 so adhered, the remaining portion of the backing sheet 20 is removed and the tape 16 bearing the exposed pressure sensitive adhesive 18 and adhered to the side sheet 12 is folded onto the back cover of the magazine 28 with pressure sensitive adhesive making secured contacting engagement therewith. As a result, the magazine is covered front and back by the respective cover sheets 12, 14, and is secured by the pressure sensitive adhesive 18 carried by the tape 16.

All of the pressure sensitive adhesive is adhered to the front and back covers of the magazine 28 along narrow bands on either side of the spine thereof. Because of the cut-outs 26, the pressure sensitive adhesive terminates short of the exposed top and bottom portions of the magazine 28, so that no pressure sensitive adhesive extends beyond the magazine. With the tape 16 having a thickness on the order of 1–3 mils, it is flexible and can endure extensive repeated use of the magazine 28 without failure. As shown, the tape 16 bearing the pressure sensitive adhesive 18 secures over the cover of the portion of the magazine bearing the staples 40 which pass through the thickness of the magazine at the center thereof to secure the pages and cover of the magazine together in standard fashion.

Another embodiment of the protective magazine cover according to the invention is designated by the numeral 32 in FIG. 4. It will be appreciated that the protective cover 32 is substantially the same as the protective cover 10 discussed above, but for the extension of a web or tail 34 from each of the ends of the tape 16. Each of the webs or tails 34 extends to an associated lateral flap 36 and, as in FIG. 1, is covered with an appropriate backing sheet 20 bearing a release layer 22 and received upon a pressure sensitive adhesive coating 18. Further, and as presented in the embodiments of FIGS. 1 and 2, a pressure sensitive adhesive layer 18 secures the sheets 12, 14 to the tape 16 along opposed lateral edges thereof.

The protective magazine cover 32 of FIG. 4 is used in a similar fashion to the cover 10 of FIGS. 1–3. A cover 32 of appropriate size is selected to cover the desired magazine, assuring that there is some extension of the cover sheets 12, 14 beyond the edges of the magazine to be covered. In this embodiment, the totality of the backing sheet 20 is removed, to expose the pressure sensitive adhesive therebeneath, between the lateral edges of the sheets 12, 14, and along the respective tails or webs 34 and flaps 36. The spine of the magazine engages the exposed pressure sensitive adhesive in alignment with the webs 34 at the top and bottom thereof. Again, the alignment is made to assure that portions of the sheets 12, 14 extend above and below the edges of the magazine covers. The pressure sensitive adhesive of the tape 16 is adhered along both sides of the spine of the magazine to the front and back cover portions. The magazine is then opened to the center thereof, exposing the inner portion of the staples 40 at the center page of the magazine. The webs or tails 34 are then extended from the cover at the top and bottom thereof, over the thickness of the totality of the magazine pages, and onto the center page of the magazine as shown in FIG. 5. Here, the pressure sensitive adhesive of the lateral flaps 36 is adhered to the inner page of the magazine, bridging the center thereof as shown. Accordingly, the webs or tails 34, extending from the tape 16, sandwich the cover page of the magazine with the inner page of the magazine, further providing the integrity of the magazine as a whole and supplementing the securement provided by the staples 40.

As further shown in FIG. 5, a lateral edge overlap 42 is provided by the respective front and back portions 14, 12, and similar longitudinal overlaps 44 are also provided, assuring totality of the protection of the magazine. Again, the cutout portion 26 assures that no exposed pressure sensative adhesive 18 will be present when the cover 32 is adhered to the magazine 38.

In the preferred embodiment of the invention, the sheets 12, 14 are provided separate from each other and adhered together by means of the tape 16 and pressure sensitive adhesive 18 as discussed above. This is necessitated because it is preferred that the sheets 12, 14 be thicker and less flexible than the center and more flexible tape 16. The utility of the protective covers 10, 32 is thus enhanced. However, it will be appreciated that a suitable cover such as the covers 10, 32 could be manufactured from a single piece of polyester which is thick enough to provide protection and "body" while being thin enough to provide the requisite flexibility. In such an embodiment, a band of pressure sensitive adhesive would simply be applied along the center portion of the polyester sheet and be covered with the backing sheet 20 and release layer 22 discussed above. The utility and operation of the resultant covers 10, 32 would be the same.

It will further be appreciated by those skilled in the art that the lamination of the tape 16 to the sheets 12, 14 would follow standard laminating procedures and that the removal of the cut-out area 26 and/or formation of the tails 34 and flaps 36 could be readily achieved using standard die cutting operations. Further, trimming of the covers 10, 32 to afford an appropriate overlap of the magazine edges by the covers 10, 32 may be accomplished by any of numerous techniques.

Thus it can be seen that the objects of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. A magazine cover, comprising:

front and back cover sheets for respectively covering a front and back of the magazine; and a carrier interconnecting adjacent lateral edges of said front and back cover sheets, said carrier having a layer of pressure sensitive adhesive extending between said lateral edges for engaging the front and back covers of the magazine along narrow bands on either side of the spine of the magazine.

2. The magazine cover according to claim 1, wherein said front and back cover sheets are transparent.

3. The magazine cover according to claim 2, wherein said strip of pressure sensitive adhesive terminates short of ends of said lateral edges of said front and back cover sheets.

4. The magazine cover according to claim 3, wherein said carrier comprises a tape having a backing sheet releasably adhered thereto.

5. The magazine cover according to claim 4, wherein said backing sheet is longitudinally slit from one end thereof to another.

6. The magazine cover according to claim 4, wherein said front and back cover sheets are independent of each other and secured together by said tape.

7. The magazine cover according to claim 2, wherein said layer of pressure sensitive adhesive is of a uniform width in an area short of ends of said lateral edges of said front and back cover sheets and of a narrower width extending beyond each of said ends and terminating at respective transverse lateral flaps.

8. The magazine cover according to claim 7, wherein said carrier comprises a transparent tape having a backing sheet releasably attached thereto.

9. The magazine cover according to claim 8, wherein said front and back cover sheets are separate and distinct from each other, and interconnected by said tape.

10. A magazine cover, comprising:

a transparent front cover sheet;

a transparent back cover sheet; and a transparent pressure sensitive adhesive tape adhered at edges thereof to respective adjacent lateral edges of said front and back cover sheets and bridging said adjacent lateral edges, said tape comprising a tail extending from each end thereof and beyond said ends of said lateral edges of said front and back sheets, each of said tails having a lateral flap at an end thereof orthogonal to said tail.

11. The magazine cover as recited in claim 10, wherein said tape stops short of ends of said lateral edges of said front and back cover sheets.

12. The magazine cover as recited in claim 11, wherein said tape has a releasable backing sheet having a longitudinal slit therealong.

* * * * *